US010085516B2

(12) United States Patent
Adami et al.

(10) Patent No.: US 10,085,516 B2
(45) **Date of Patent: *Oct. 2, 2018**

(54) ARTICLE OF FOOTWEAR WITH REINFORCED ELASTIC UPPER

(71) Applicant: Nike, Inc., Beaverton, OR (US)

(72) Inventors: Giovanni Adami, Montebelluna (IT); Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 600 days.

This patent is subject to a terminal disclaimer.

(21) Appl. No.: 13/777,230

(22) Filed: Feb. 26, 2013

(65) Prior Publication Data

US 2014/0237858 A1 Aug. 28, 2014

(51) Int. Cl.
*A43B 23/02* (2006.01)
*A43B 3/00* (2006.01)
(Continued)

(52) U.S. Cl.
CPC ..... *A43B 23/028* (2013.01); *A43B 3/0078* (2013.01); *A43B 3/26* (2013.01); *A43B 13/04* (2013.01); *A43B 13/122* (2013.01); *A43B 13/141* (2013.01); *A43B 13/184* (2013.01); *A43B 23/021* (2013.01); *A43B 23/022* (2013.01); *A43B 23/0205* (2013.01); *A43B 23/025* (2013.01); *A43B 23/027* (2013.01); *A43B 23/0235* (2013.01); *A43B 23/0255* (2013.01); *A43B 23/0275* (2013.01);
(Continued)

(58) Field of Classification Search
CPC ..... A43B 23/028; A43B 23/0255; A43B 23/0205; A43B 23/025; A43B 23/022; A43B 23/0235; A43B 23/021; A43B 23/027; A43B 23/0275; A43B 23/0215
USPC ..... 36/45, 48, 47, 49
See application file for complete search history.

(56) References Cited

U.S. PATENT DOCUMENTS 1,227,981 A * 5/1917 Tynes ..... A43B 7/06 36/3 A
1,677,370 A 7/1928 Roewade
(Continued)

FOREIGN PATENT DOCUMENTS

CN 2162110 Y 4/1994
CN 101179958 A 5/2008
(Continued)

OTHER PUBLICATIONS

International Preliminary Report on Patentability (including Written Opinion of the ISA) dated Sep. 11, 2015 in PCT/US2014/018274.
(Continued)

*Primary Examiner* — Jila M Mohandesi
(74) *Attorney, Agent, or Firm* — Honigman Miller Schwartz and Cohn LLP; Matthew H. Szalach; Jonathan P. O'Brien

(57) ABSTRACT

An article of footwear is provided, which may include an upper and a sole structure. The upper may include an elastic skin material forming at least a portion of an external surface of the upper. In addition, the upper may include substantially inelastic reinforcing material selectively located adjacent portions of the elastic skin material, wherein the elastic skin material is more elastic than the substantially inelastic reinforcing material.

25 Claims, 13 Drawing Sheets

(51) Int. Cl.

| | |
|---|---|
| ***A43B 3/26*** | (2006.01) |
| ***A43B 13/04*** | (2006.01) |
| ***A43B 13/12*** | (2006.01) |
| ***A43B 13/14*** | (2006.01) |
| ***A43B 13/18*** | (2006.01) |
| ***A43C 1/00*** | (2006.01) |
| ***A43C 5/00*** | (2006.01) |
| ***A43C 15/16*** | (2006.01) |

(52) U.S. Cl.
CPC ..... *A43C 1/00* (2013.01); *A43C 5/00* (2013.01); *A43C 15/16* (2013.01)

(56) References Cited

U.S. PATENT DOCUMENTS

| | | | | |
|---|---|---|---|---|
| 2,101,723 | A | 12/1937 | Smith | |
| 2,147,197 | A * | 2/1939 | Glidden | A43B 1/02 36/3 A |
| 2,158,153 | A * | 5/1939 | Roberts | A43B 1/10 12/142 E |
| 2,772,489 | A * | 12/1956 | Porter | A43B 7/32 2/2.5 |
| 3,769,723 | A | 11/1973 | Masterson et al. | |
| 3,931,685 | A * | 1/1976 | Laukaitis | A43B 5/02 36/128 |
| 4,222,183 | A * | 9/1980 | Haddox | A43B 5/00 36/114 |
| 4,255,876 | A * | 3/1981 | Johnson | A43B 5/00 36/129 |
| 4,447,967 | A * | 5/1984 | Zaino | A43B 23/0235 36/45 |
| 5,555,650 | A | 9/1996 | Longbottom et al. | |
| 5,709,954 | A | 1/1998 | Lyden et al. | |
| 5,765,296 | A * | 6/1998 | Ludemann | A43B 23/047 36/50.1 |
| 6,029,376 | A * | 2/2000 | Cass | A43C 1/04 36/50.1 |
| 6,505,424 | B2 | 1/2003 | Oorei et al. | |
| 6,715,218 | B2 | 4/2004 | Johnson | |
| 6,862,820 | B2 | 3/2005 | Farys et al. | |
| 6,910,288 | B2 * | 6/2005 | Dua | A43B 1/04 12/146 C |
| 7,424,783 | B2 * | 9/2008 | Meschter | A41D 1/04 2/227 |
| 7,765,718 | B2 | 8/2010 | Wilkenfeld | |
| 7,996,924 | B2 | 8/2011 | Wright et al. | |
| 8,578,632 | B2 * | 11/2013 | Bell | A43B 1/0072 36/45 |
| 2004/0181972 | A1 | 9/2004 | Csorba | |
| 2005/0282454 | A1 | 12/2005 | Meschter et al. | |
| 2009/0241374 | A1 * | 10/2009 | Sato | A43B 23/047 36/45 |
| 2010/0037483 | A1 | 2/2010 | Meschter et al. | |
| 2010/0251564 | A1 | 10/2010 | Meschter | |
| 2011/0035963 | A1 | 2/2011 | Baker et al. | |
| 2011/0099848 | A1 | 5/2011 | Tomat et al. | |
| 2012/0011744 | A1 | 1/2012 | Bell et al. | |
| 2012/0174433 | A1 * | 7/2012 | Mahoney | A43B 7/1425 36/28 |
| 2012/0246973 | A1 | 10/2012 | Dua | |
| 2012/0255201 | A1 * | 10/2012 | Little | A43B 1/04 36/84 |
| 2012/0297642 | A1 | 11/2012 | Schaefer et al. | |
| 2013/0019508 | A1 | 1/2013 | Smith et al. | |
| 2013/0047471 | A1 | 2/2013 | Liang | |
| 2013/0312284 | A1 | 11/2013 | Berend et al. | |
| 2015/0013187 | A1 * | 1/2015 | Taniguchi | A43B 1/04 36/84 |

FOREIGN PATENT DOCUMENTS

| | | | |
|---|---|---|---|
| CN | 101909471 | A | 12/2010 |
| CN | 102548442 | A | 7/2012 |
| CN | 103687507 | A | 3/2014 |
| DE | 202010017958 | U1 | 6/2013 |
| EP | 1621089 | | 2/2006 |
| EP | 2 484 240 | A2 | 8/2012 |
| FR | 2428987 | A1 | 1/1980 |
| GB | 2230174 | | 10/1990 |
| WO | 98/25491 | A1 | 6/1998 |
| WO | 2011082391 | A1 | 7/2011 |
| WO | 2013019934 | A1 | 2/2013 |

OTHER PUBLICATIONS

International Search Report and Written Opinion dated Jun. 24, 2014 in PCT/US2014/018274.

Office Action for Chinese Patent Application No. 201480010302.5, dated Jul. 13, 2016. 15 pages (with English Translation).

United States Patent and Trademark Office, Non-Final Rejection for U.S. Appl. No. 15/276,466, dated Feb. 28, 2017 (12 pages).

State Intellectual Property Office, Chinese Office Action for Application No. 201480010302.5, dated Mar. 8, 2017 (6 pages).

State Intellectual Property Office, Chinese Office Action for Application No. 201580022695.6, dated Nov. 24, 2017.

State Intellectual Property Office, Chinese Office Action for Application No. 201480010302.5, dated Sep. 18, 2017.

International Search Report and Written Opinion for Application No. PCT/US2015/025906, dated Aug. 4, 2015, 12 pages.

Detailed Observations and Voluntary Amendments filed Mar. 8, 2016 in Chinese Utility Patent Application No. 201480010302.5, 84 pages.

Voluntary Amendments filed Jan. 13, 2016 for European Application No. 14717230.8.

* cited by examiner

ARTICLE OF FOOTWEAR WITH REINFORCED ELASTIC UPPER

BACKGROUND

The present disclosure is directed to an article of footwear and, more particularly, to an article of footwear having a reinforced elastic upper.

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces (that is, providing cushioning) during walking, running, and other ambulatory activities, the sole structure may influence foot motions (for example, by resisting pronation), impart stability, and provide traction, for example. Accordingly, the upper and the sole structure operate cooperatively to provide a comfortable structure that is suited for a wide variety of athletic activities.

The upper is often formed from a plurality of material elements (for example, textiles, polymer sheets, foam layers, leather, and synthetic leather) that are stitched or adhesively bonded together to define a void or cavity on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permit entry and removal of the foot from the void within the upper. In addition, the upper may include a tongue that extends under the lacing system to enhance adjustability and comfort of the footwear, and the upper may incorporate a heel counter or other stabilizing structure.

The upper may also include provisions to improve fit, comfort, and performance. Materials selection and placement may be utilized to achieve certain desired characteristics.

SUMMARY

In one aspect, the present disclosure is directed to an article of footwear including a sole structure fixedly attached to an upper configured to receive a foot of a wearer. The upper may include an elastic skin material forming at least a portion of an external surface of the upper. In addition, the upper may include substantially inelastic reinforcing material selectively located adjacent portions of the elastic skin material, wherein the elastic skin material is more elastic than the substantially inelastic reinforcing material.

In another aspect, the present disclosure is directed to a method of making an article of footwear. The method may include forming, from an elastic skin material, an externally exposed portion of an upper configured to receive a foot of a wearer. In addition, the method may include fixedly attaching a sole structure to the upper. Further, the method may include assembling, as part of the upper, a substantially inelastic reinforcing material, by selectively locating the reinforcing material adjacent portions of the elastic skin material, wherein the elastic skin material is more elastic than the substantially inelastic reinforcing material.

Other systems, methods, features and advantages of the current embodiments will be, or will become, apparent to one of ordinary skill in the art upon examination of the following figures and detailed description. It is intended that all such additional systems, methods, features and advantages be included within this description and this summary, be within the scope of the current embodiments, and be protected by the following claims.

BRIEF DESCRIPTION OF THE DRAWINGS

The current embodiments can be better understood with reference to the following drawings and description. The components in the figures are not necessarily to scale, emphasis instead being placed upon illustrating the principles of the current embodiments. Moreover, in the figures, like reference numerals designate corresponding parts throughout the different views.

DETAILED DESCRIPTION

Figure 1:
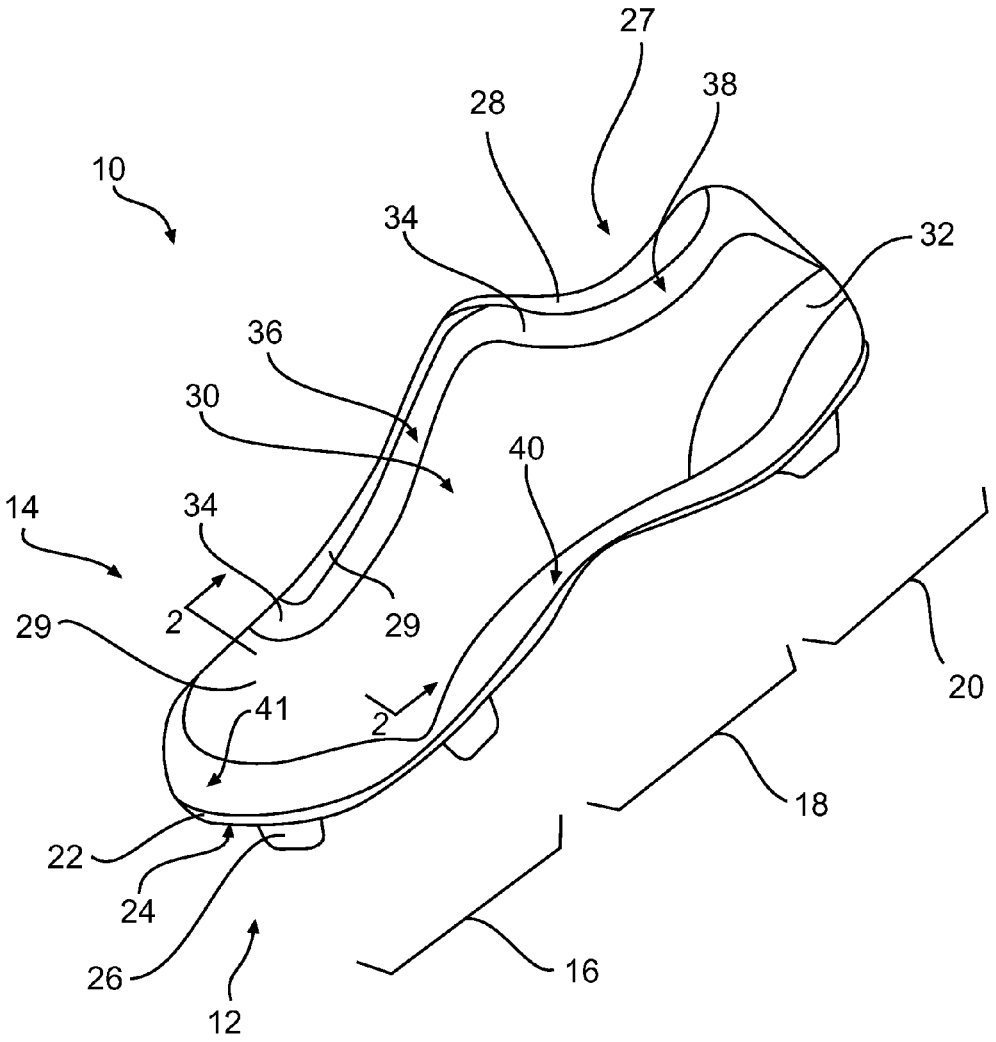
FIG. 1 is a schematic perspective view of an embodiment of an article of footwear having an upper formed of an elastic skin material and a reinforcing material.

The following discussion and accompanying figures disclose a sole structure for an article of footwear. Concepts associated with the footwear disclosed herein may be applied to a variety of athletic footwear types, including soccer shoes, running shoes, baseball shoes, basketball shoes, cross-training shoes, cycling shoes, football shoes, golf shoes, tennis shoes, walking shoes, and hiking shoes and boots, for example. The concepts may also be applied to footwear types that are generally considered to be non-athletic, including dress shoes, loafers, sandals, and work boots. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure. In some cases, the longitudinal direction may extend from a forefoot portion to a heel portion of the sole. Also, the term "lateral," as used throughout this detailed description and in the claims, refers to a direction extending a width of a sole. In other words, the lateral direction may extend between a medial side and a lateral side of footwear, with the lateral side of footwear being the surface that faces away from the other foot, and the medial side being the surface that faces toward the other foot.

Furthermore, the term "vertical," as used throughout this detailed description and in the claims, refers to a direction generally perpendicular to a lateral and longitudinal direction. For example, in cases where a sole is planted flat on a ground surface, the vertical direction may extend from the ground surface upward. It will be understood that each of these directional adjectives may be applied to individual components of a sole. In addition, the terms "upward" and "downward," as used throughout this detailed description and the claims, refer to modes of vertical bending and/or deflection. For example, the term "upwards" refers to the vertical direction heading away from a ground surface, while the term "downwards" refers to the vertical direction heading towards the ground surface.

For purposes of this disclosure, the term fixedly attached shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques.

For purposes of this disclosure, the term "standard shoe size" shall refer to any recognized shoe sizing system. Recognized sizing systems are based typically on foot length and, in some cases, foot width. An exemplary such system is the Mondopoint system, which is recommended by ISO 9407:1991. The Mondopoint system designates shoe sizes as a ratio of (foot length for which the shoe is suited)/(foot width for which the shoe is suited) in millimeters. The system recognized in the United Kingdom and Ireland is based on the length of the last used to make the shoe, measured in barleycom (approximately ⅓ inch). North American shoe sizing systems generally add one to the corresponding UK size, because the customary or traditional shoe sizing system in North America begins at 1 rather than zero as the UK system does. Further, various sizing systems can include different scales for adult, children, and women's shoes. Other parts of the world follow similar shoe sizing systems with slight variations to those recognized in the UK and North America. The term "standard shoe size" shall refer to a shoe size of any recognized shoe sizing system. In some cases, a "standard shoe size" may be referred to as a "box size" since such sizes may be labeled on the box in which the shoes are sold. The term "standard shoe size" may include whole sizes, half sizes, and any other recognized fractional sizes.

FIG. 1 depicts an embodiment of an article of footwear 10, which may include a sole structure 12 and an upper 14. For reference purposes, footwear 10 may be divided into three general regions: a forefoot region 16, a midfoot region 18, and a heel region 20. Forefoot region 16 generally includes portions of footwear 10 corresponding with the toes and the joints connecting the metatarsals with the phalanges. Midfoot region 18 generally includes portions of footwear 10 corresponding with an arch area of the foot. Heel region 20 generally corresponds with rear portions of the foot, including the calcaneus bone. Region 16, region 18, and region 20 are not intended to demarcate precise areas of footwear 10. Rather, region 16, region 18, and region 20 are intended to represent general relative areas of footwear 10 to aid in the following discussion.

Since sole structure 12 and upper 14 both span substantially the entire length of footwear 10, the terms forefoot region 16, midfoot region 18, and heel region 20 apply not only to footwear 10 in general, but also to sole structure 12 and upper 14, as well as the individual elements of sole structure 12 and upper 14.

The disclosed footwear components may be formed of any suitable materials. In some embodiments, one or more materials disclosed in Lyden et al. (U.S. Pat. No. 5,709,954), which is hereby incorporated by reference in its entirety, may be used.

Sole structure 12 may be fixedly attached to upper 14 (for example, with adhesive, stitching, welding, and/or other suitable techniques) and may have a configuration that extends between upper 14 and the ground. Sole structure 12 may include provisions for attenuating ground reaction forces (that is, cushioning the foot). In addition, sole structure 12 may be configured to provide traction, impart stability, and/or limit various foot motions, such as pronation, supination, and/or other motions.

The configuration of sole structure 12 may vary significantly according to one or more types of ground surfaces on which sole structure 12 may be used, for example, natural turf, synthetic turf, dirt, pavement (for example, asphalt, concrete, and other types of pavement), as well as indoor surfaces, such as hardwood, synthetic rubber surfaces, tile, and other indoor surfaces. In addition, the configuration of sole structure 12 may vary significantly according to the type of activity for which footwear 10 is anticipated to be used (for example, running, walking, soccer, baseball, basketball, and other activities). Footwear 10 is depicted in the accompanying figures as a cleated shoe, having a sole structure suited for natural and/or synthetic turf. Although footwear 10, as depicted, may be suited for soccer, such a cleated shoe may be applicable for use in other activities on natural and/or synthetic turf, such as baseball, football, and other such activities where traction and grip may be enhanced by cleat members. However, many of the features of footwear 10 discussed herein may be applicable to other types of footwear, including non-cleated footwear.

In some embodiments, sole structure 12 may include multiple components, which may individually and/or collectively provide footwear 10 with a number of attributes, such as support, rigidity, flexibility, stability, cushioning, comfort, reduced weight, traction, and/or other attributes. In some embodiments, sole structure 12 may include a ground engaging sole component 22.

Sole component 22 may be formed of suitable materials for achieving the desired performance attributes. Sole component may be formed of any suitable polymer, composite, and/or metal alloy materials. Exemplary such materials may include thermoplastic and thermoset polyurethane, polyester, nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In some embodiments, sole component 22 may be fashioned from a durable and wear-resistant material (for example, rubber). Other suitable materials will be recognized by those having skill in the art.

Sole component 22 may include a ground engaging lower surface 24 configured to engage the ground. Accordingly, sole component 22 may include one or more ground engaging members 26 extending from lower surface 24 of sole component 22 and configured to provide traction. It will be understood that any type of ground-engaging members could be used with sole structure 12. In some cases, ground-engaging members 26 could be configured to engage a soft ground surface. For example, in one embodiment, ground-engaging members 26 may be configured to engage a soft grass surface. In other cases, ground-engaging members 26 could be configured to engage a hard surface. For example, in one embodiment ground-engaging members 26 could be configured to engage a hard grass surface or artificial turf. In still other embodiments, any other types of ground-engaging members could be used.

Sole structure 12 may also include other components, such as an insole (sockliner), midsole, and/or chassis plate. The insole may be a thin, compressible member located (in some cases removably) within the upper and adjacent to a plantar (that is, lower) surface of the foot to provide comfort, support, and stability. The midsole is secured to a lower surface of the upper and forms a middle layer of the sole structure. Many midsole configurations are primarily formed from a resilient polymer foam material, such as polyurethane (PU) or ethyl vinyl acetate (EVA) that extends throughout the length and width of the footwear. The midsole may also incorporate plates, moderators, fluid-filled chambers, and/or other elements that further attenuate forces, influence the motions of the foot, and/or impart stability, for example.

Selection and configuration of the insole, midsole, and chassis plate may be based on the activity and athlete for which article of footwear 10 is configured. In some cases, one or more such components may be omitted from sole structure 12. For example, an article of footwear configured for soccer may omit a midsole. In some embodiments, a chassis plate may be incorporated into sole component 22. In addition, for soccer configurations, a minimalist insole may be implemented in order to save weight, and provide a low-to-the ground stance, which is desirable for a soccer shoe.

As shown in FIG. 1, upper 14 may define an ankle opening 27 in heel region 20, ankle opening 27 providing access to an interior cavity 28. As will be discussed below, in some embodiments, upper 14 may include a closure mechanism, such as a lace. FIG. 1, however, shows an embodiment that omits laces and, instead, opts for a configuration that utilizes a stretch to fit upper material.

Upper 14 may include one or more material elements (for example, textiles, foam, leather, and synthetic leather), which may be stitched, adhesively bonded, molded, or otherwise formed to define an interior cavity configured to receive a foot. The material elements may be selected and arranged to selectively impart properties such as durability, air-permeability, wear-resistance, flexibility, and comfort.

In some embodiments, upper 14 may include visual patterns of ornamental and/or functional design. In some embodiments, the visual patterns may be digitally printed on the upper materials. However, any suitable method may be utilized to incorporate visual patterns on upper 14.

A footwear upper may include an elastic material forming at least a portion of the upper. Exemplary elastic materials suitable for use in the disclosed embodiments may include latex, Spandex or elastane (which is often sold under the trademark LYCRA®), and/or any other suitable elastic materials.

The elastic material may provide improved fit and comfort. Incorporation of the elastic material enables a close-fitting article of footwear to remain comfortable. In some athletic activities, such as soccer, a particularly close-fitting upper is desirable. For example, while some athletic shoes are desired to fit with a small amount of space (for example ⅜ to ½ inch) between the wearer's toes and the inside front of the cavity within the upper, soccer shoes are desired to fit with no space or virtually no space between the toes and the inside front of the upper. Any extra length of a soccer shoe will tend to catch on the ground when attempting to kick a soccer ball. In addition, a soccer shoe is desired to fit closely around the top and sides of the shoe, to prevent the foot from sliding around inside the shoe, and thereby provide a predictable outer surface which will contact the ball. Further, a relatively thin upper material is also desirable for a soccer shoe in order to provide feel of the ball as well as reduced weight. Thus, in order to provide a close-fitting, thin upper, that is comfortable and high performing, an elastic material may be used in the upper.

In some embodiments, as shown in FIG. 1, upper 14 may include an elastic skin material 29 forming at least a portion of an external surface 30 of upper 14. Because upper 14 may include elastic skin material 29, for a given standard shoe size, cavity 28 defined by upper 14 may be formed to have a volume smaller than the volume of the majority of wearer's feet having the given standard shoe size. For example, in some embodiments, for a given standard shoe size, cavity 28 may have a volume that is smaller than approximately 90 percent of wearer's feet having the given standard shoe size. In other embodiments, the percentage of wearer's feet that cavity 28 has a smaller volume than may vary, and thus, may be more or less than 90 percent.

Having a smaller internal cavity 28, upper 14 may have a stretch-to-fit configuration. That is, upper 14 (or portions of upper 14) may expand when inserting the foot into footwear 10. The result is an upper that fits much like a sock, conforming to virtually all of the contours of the foot. In addition, because the stretch-to-fit configuration includes an upper that fits the foot in a stretched manner, this configuration provides an elastic binding of the upper against the foot, by virtue of the upper's elastic bias. Accordingly, in some embodiments, such an upper may be provided without a closure mechanism (for example, laces, straps, or other closure systems).

In some embodiments, the upper may include one or more reinforcing structures, which may provide strength, stability, durability, and other performance benefits. For example, in some embodiments, the upper may include substantially inelastic reinforcing material selectively located adjacent portions of the elastic skin material. Exemplary inelastic reinforcing materials that may be used with the disclosed embodiments may include, for example, leather, synthetic leather, Lorica, K-lite, or other inelastic or substantially inelastic materials. Exemplary such materials may include 0.6 mm Lorica or 0.8 mm K-lite. Other thicknesses may also be used where suitable to achieve desired performance characteristics.

In some embodiments, the reinforcing material may be layered with, but not attached to, the elastic skin material. In other embodiments, the reinforcing material may be attached, at least partially, to other components of the footwear. In some embodiments, the reinforcing material may be attached to the elastic skin material, for example, by stitching, adhesive, bonding, welding, or any other suitable attachment method. In some embodiments, the reinforcing material may be attached in only select areas to the elastic skin material. For example, a strip of reinforcing material may be attached to the elastic skin material only at the ends of the strip, leaving the middle portion of the strip disconnected from the elastic skin material. This may provide the upper with greater flexibility to conform to the shape of the foot, while maintaining the strength benefits of the reinforcing material.

In addition to the placement of the reinforcing material, the amount of reinforcing material may be selected according to predetermined performance criteria. For example, more reinforcing material may be utilized to provide more strength and support, while less reinforcing material may be utilized to provide flexibility, stretchability, and reduced weight.

In some embodiments, the inelastic reinforcing material may be rigid or substantially rigid. For example, in some embodiments, upper 14 may include a substantially rigid heel counter 32, as shown in FIG. 1. Heel counter 32 may provide stability and support to the heel region of footwear 10. Rigid reinforcing materials used for components such as heel counter 32 may include rigid plastics, metals, and other substantially rigid materials. In some embodiments, at least a portion of heel counter 32 may be exposed on an external portion of upper 14. In some embodiments, at least a portion of heel counter 32 may be disposed internal, for example, under other layers of upper 14. Further, it will be understood that reinforcing components such as heel counter 32 may be optional. Accordingly, in some embodiments, the heel counter may be omitted.

In some embodiments, upper 14 may include inelastic (or substantially inelastic) reinforcing material 34 disposed adjacent elastic skin material 29 in select locations of upper 14. Inelastic reinforcing material 34 may include textiles, thermoplastic, leather, synthetic leather, vinyl, and/or any other suitable inelastic material. Inelastic (or substantially inelastic) reinforcing material (such as reinforcing material 34) may have any suitable level of elasticity, which may be relatively low. It will be understood that the term "elastic material" (such as elastic skin material 29), as used in this specification and claims, shall refer to material that is more elastic than inelastic reinforcing material (such as substantially inelastic reinforcing material 34). To illustrate an exemplary comparison between elastic and inelastic materials suitable for use in the disclosed embodiments, an exemplary footwear upper according to the disclosed embodiments may include an elastic material such as LYCRA® and a relatively inelastic material (as compared to LYCRA®) such as leather or synthetic leather.

Inelastic reinforcing material 34 may be located in any suitable portion of upper 14. For example, as shown in FIG. 1, inelastic reinforcing material 34 may be disposed around an instep region 36 of upper 14 and/or in an opening region 38 around opening 22 of upper 14. In some embodiments, inelastic reinforcing material 34 in instep region 36 may be continuous with inelastic reinforcing material 34 in opening region 38, as shown in FIG. 1. Additionally, or alternatively, upper 14 may also include inelastic reinforcing material 34 located in a lower peripheral region 40 of upper 14 and/or in a toe region 41 or upper 14.

Inelastic reinforcing material 34 may be used in lower peripheral region 40 to provide several performance characteristics. For example, such a configuration may provide abrasion resistance to upper 14. In addition, such a configuration may also provide support, for example lateral support, in the base region of upper 14, which, along with sole component 22, may cradle the foot of a wearer to provide stability and support.

Figure 3:
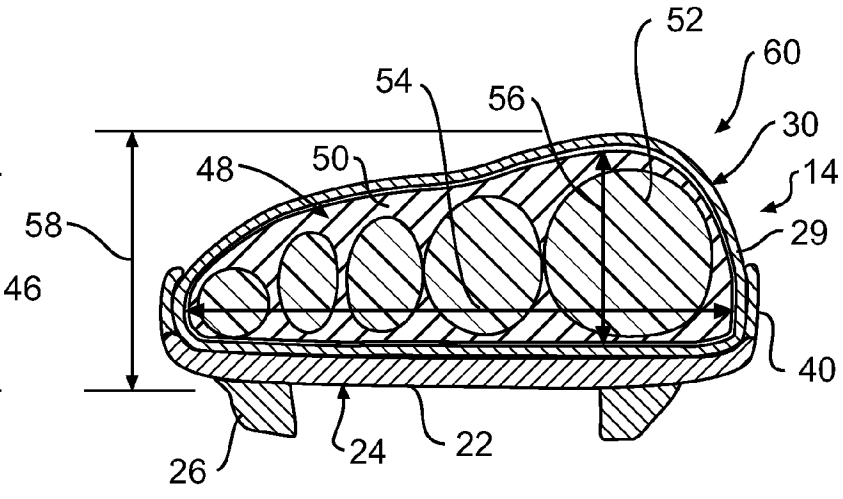
FIG. 3 is a cross-sectional view taken at line 2-2 in FIG. 1, with a foot inserted in the article of footwear.
Figure 2:
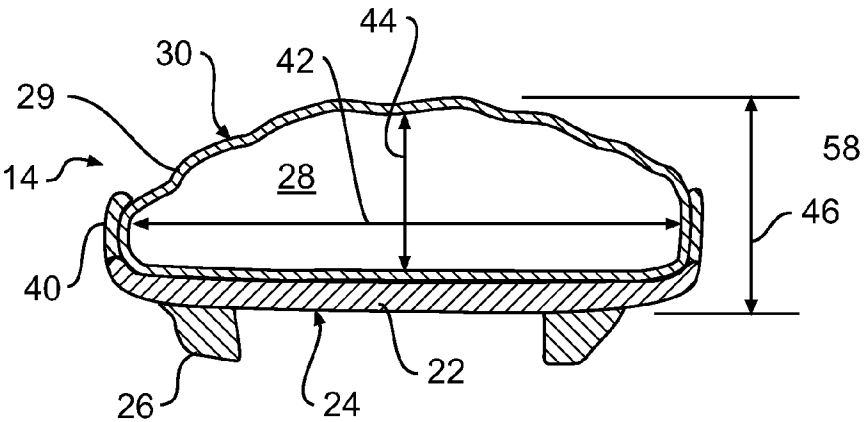
FIG. 2 is a cross-sectional view taken at line 2-2 in FIG. 1 without a foot inserted in the article of footwear.

FIGS. 2 and 3 illustrate the stretch to fit concept of upper 14 from FIG. 1. As shown in FIG. 2, upper 14, when no foot is located within cavity 28, may take on a small, and even wrinkled, rippled or sagging configuration. In this configuration, upper 14 at this particular location may be associated with a first width dimension 42 and a first height dimension 44 of cavity 28. In addition, a first footwear height dimension 46 is also illustrated in FIG. 2.

FIG. 3 shows a cross-sectional view of footwear 10 from FIG. 1 with a foot 48 inserted in upper 14. Foot 48 may include flesh 50 and bones 52. Bones 52 generally represent the phalanges of foot 48. A second width dimension 54 is shown in FIG. 3. It will be noted that, in some cases, second width dimension 54 may be substantially the same as first width dimension 42, as shown in FIGS. 2 and 3. This may be because of the reinforcement of lower peripheral region 40, which may be made of a substantially inelastic reinforcing material.

A second height dimension 56 is also shown in FIG. 3. It will be noted that, not only may second height dimension 56 be greater than first height dimension 44 of cavity 28, but also, second height dimension 56 may be located in a different lateral position from first height dimension 44. This is because foot 48, like most feet, is not tallest in the lateral center of the foot. For example, foot 48 may increase the height of upper 14 to a greater extent in a first metatarsal region 60. Also, as comparatively illustrated in FIGS. 2 and 3, second footwear height 58 may be greater than first footwear height 46. This increase in the interior volume of cavity 28 (shown in FIG. 3) may occur as foot 48 acts to substantially stretch elastic skin material 29 beyond the initial unstretched state of elastic skin material 29 (which is seen in FIG. 2).

Figure 4:
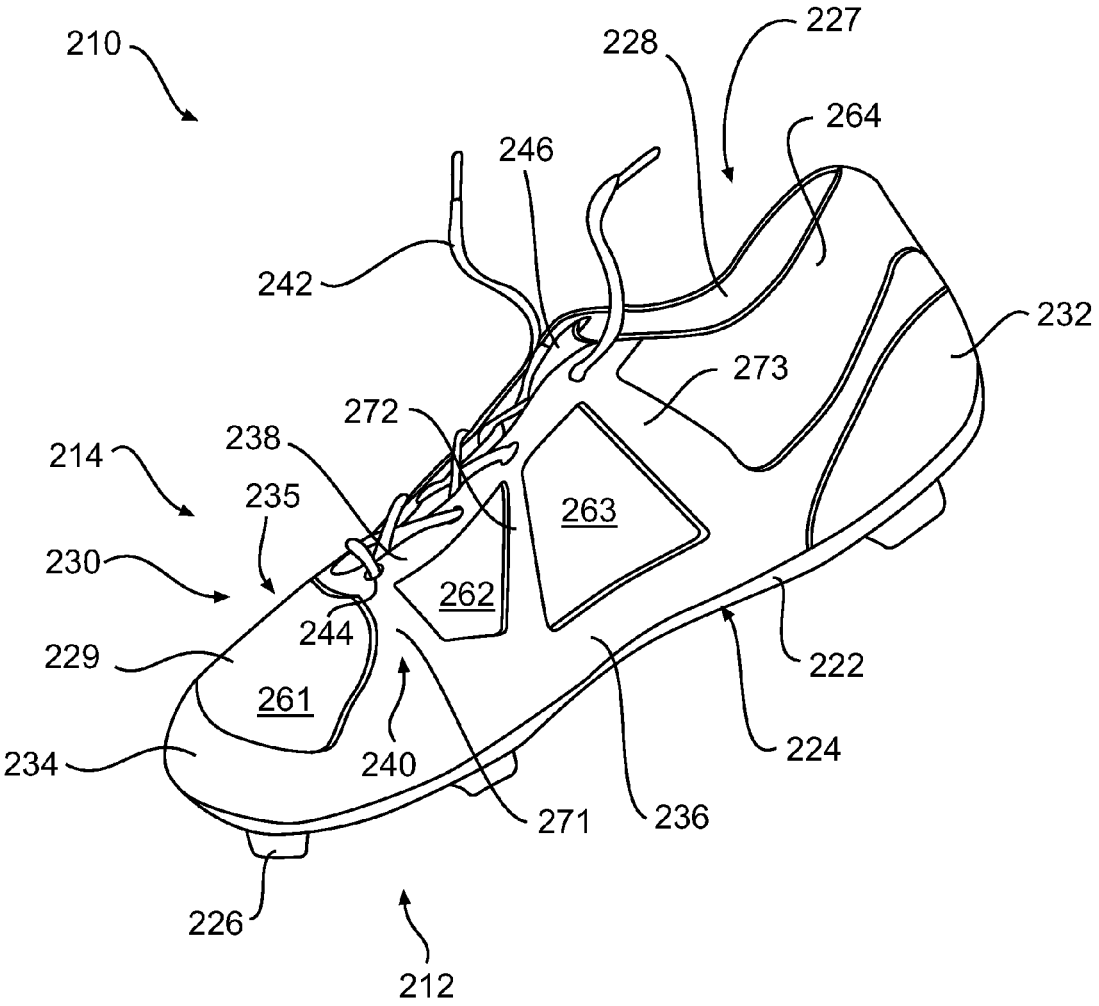
FIG. 4 is a schematic perspective view of an embodiment of an article of footwear having an upper formed of an elastic skin material and a substantially inelastic reinforcing material forming a skeletal structure.

In some embodiments, inelastic reinforcing material may be incorporated into upper 14 in select locations to provide a supportive skeletal structure. For example, as shown in FIG. 4, an article of footwear 210 may include a sole structure 212 including a ground engaging sole component 222 having a lower surface 224 and ground engaging members 226 extending from lower surface 224. In addition, footwear 210 may include an upper 214 defining an opening 227 and an internal cavity 228. Upper 214 may also include an elastic skin material 229 forming at least a portion of an external surface 230 of upper 214. These features and components may have substantially similar characteristics as their counterpart features discussed above with respect to FIG. 1.

As shown in FIG. 4, inelastic reinforcing material 234 may form a skeletal structure. In some embodiments, such a skeletal structure may be provided internal to elastic skin material 229, forming an endoskeleton, as will be discussed in great detail below. In some embodiments, however, such a skeletal structure may be provided external to elastic skin material 229, forming an exoskeleton, as shown in FIG. 4.

In some embodiments, inelastic reinforcing material 234 may be configured to surround one or more unreinforced sections 235 of elastic skin material 229 of upper 214, as shown in FIG. 4. For example, as shown in FIG. 4, unreinforced sections 235 (which may include a first unreinforced section 261, a second unreinforced section 262, a third unreinforced section 263 and a fourth unreinforced section 264, as well as additional unreinforced sections on an opposing side of upper 214) may be surrounded by a lower peripheral strip 236, an instep region strip 238, and a plurality of skeletal strips 240 (including a first skeletal strip 271, a second skeletal strip 272, and a third skeletal strip 273) extending between lower peripheral strip 236 and instep region strip 238. Skeletal strips 240 may provide tensile strength to upper 214 in a generally top-to-bottom direction. It is also noteworthy that, in some embodiments, the region of upper 214 surrounding opening 227 may be formed of elastic skin material 229. This may provide comfort and improved fit around opening 227.

As shown in FIG. 4, in some embodiments, a stretch-to-fit upper may further include a closure system, such as a lace 242 configured to secure footwear 210 to the foot of a wearer. Lace 242 may be utilized to modify the dimensions of interior cavity 228, thereby securing the foot within cavity 228 and facilitating entry and removal of the foot. Lace 242 may extend through eyelets 244 in upper 214 configured to receive lace 242. In addition, upper 214 may include a tongue portion 246, which may extend between cavity 228 and lace 242. Upper 214 may alternatively implement any of a variety of other configurations, materials, and/or closure mechanisms. For example, upper 214 may include sock-like liners instead of a more traditional tongue; alternative closure mechanisms, such as hook and loop fasteners (for example, straps), buckles, clasps, cinches, or any other arrangement for securing a foot within the void defined by upper 214.

In some embodiments, inelastic reinforcing material may be associated with eyelets 244. For example, as shown in FIG. 4, eyelets 244 may be disposed in instep region strip 238. In addition, one or more of skeletal strips 140 may be aligned with eyelets 244, as also shown in FIG. 4.

Figure 5:
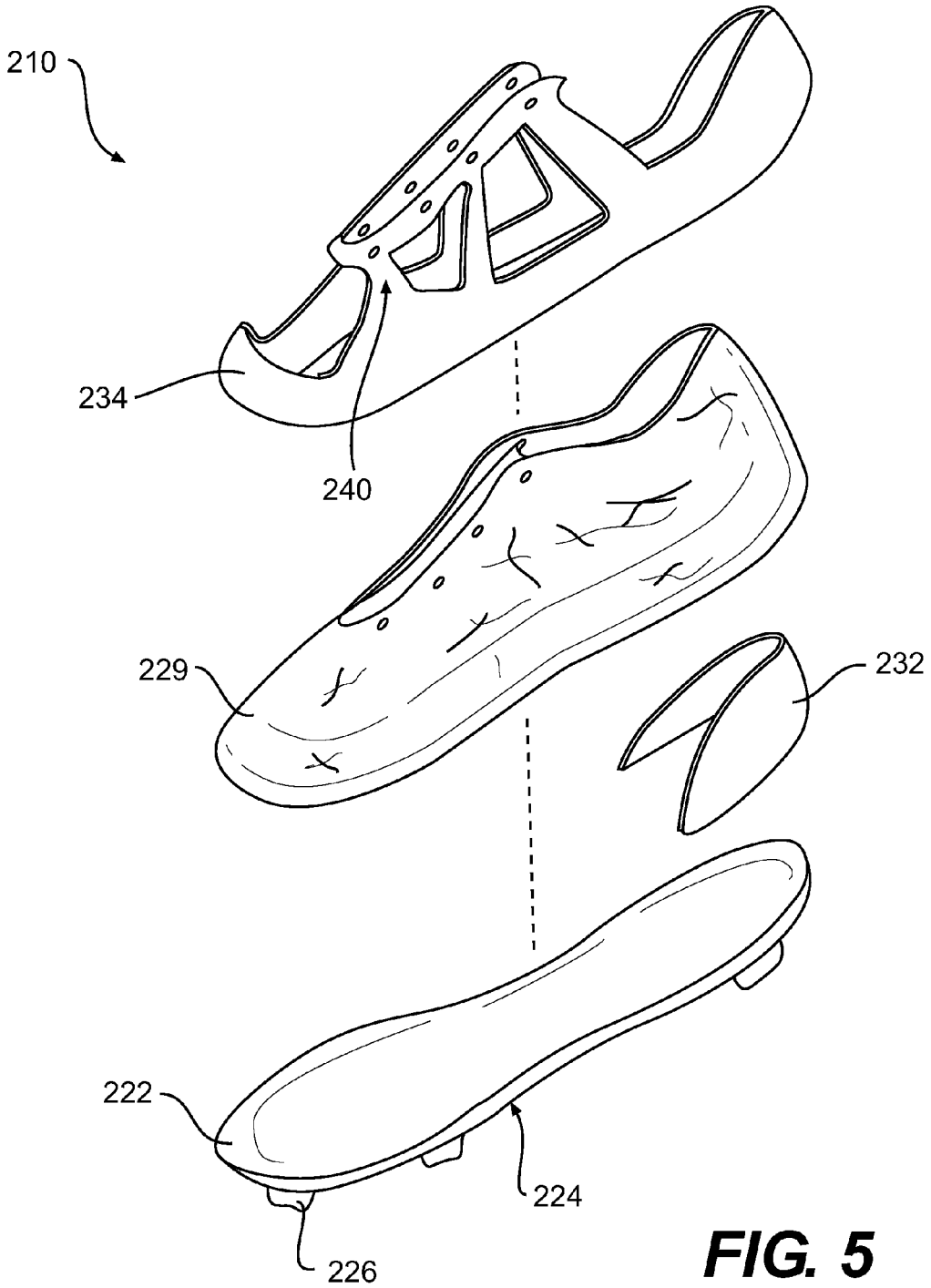
FIG. 5 is an exploded view of the article of footwear shown in FIG. 4.

FIG. 5 is an exploded view of footwear 210. As shown in FIG. 5, footwear 210 may include at least four components. In particular, an external (or in some cases an internal) structure of reinforcing material 234. Skeletal ribs 240 may be clearly observed in FIG. 5. Further, as can be seen in FIG. 5, both the medial and lateral sides of reinforcing material 234 may have substantially the same configuration. In some embodiments, however, the medial and lateral sides may have differing configurations.

Elastic skin material 229 is also shown in an isolated fashion in FIG. 5. As shown in FIG. 5, elastic skin material 229 may be provided in the form a sock-like structure configured to enclose the foot. Heel counter 232 may be assembled internally (or in some cases externally) of elastic skin material 229. In addition, sole component 222 may be fixedly attached to elastic skin material 229 and, in some cases, to reinforcing material 234 and/or heel counter 232.

Figure 6:
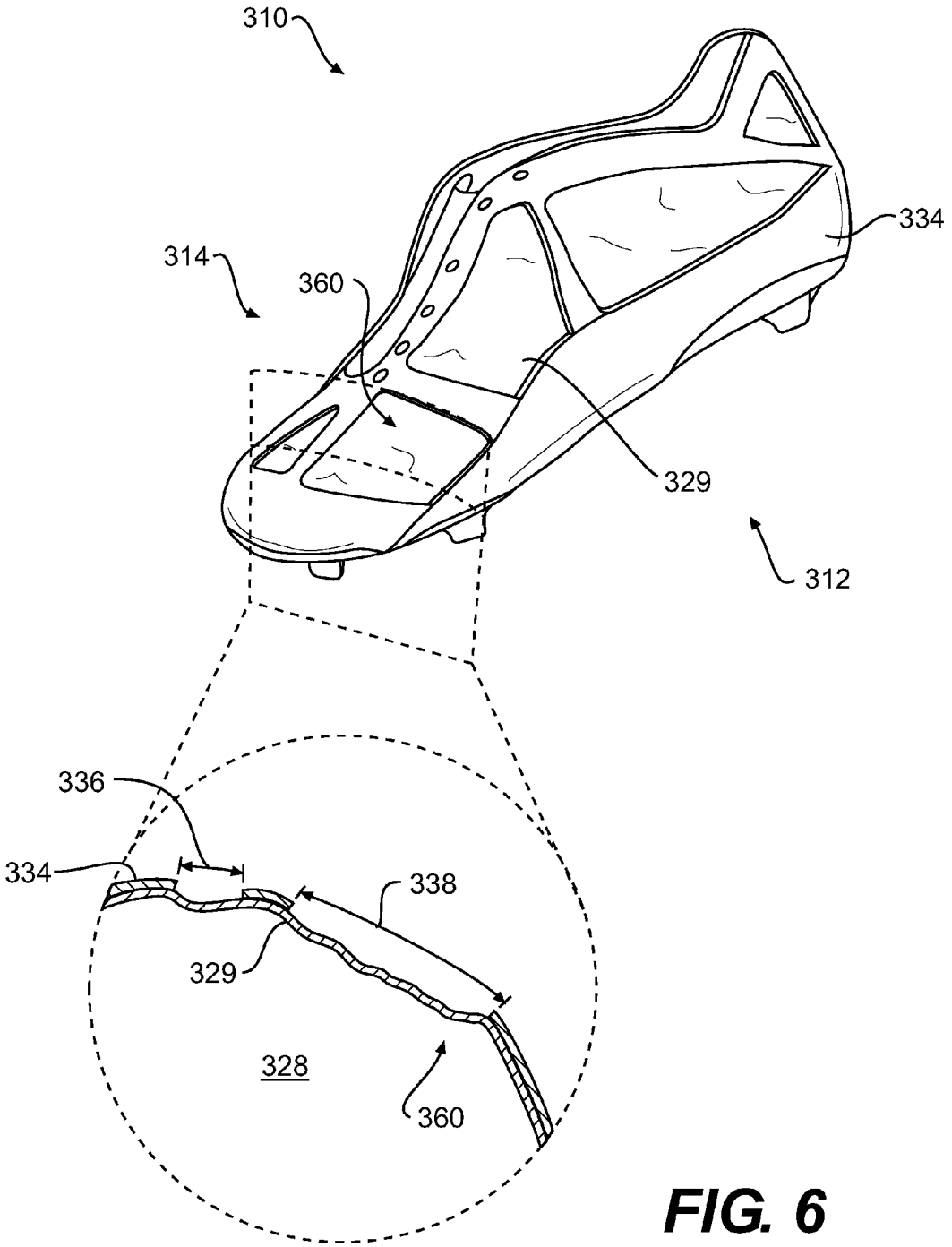
FIG. 6 is a schematic perspective view of an embodiment of an article of footwear having an upper formed of an elastic skin material and a substantially inelastic reinforcing material forming a skeletal structure, and further including eyelets for a lace.

The stretch-to-fit upper may have any suitable configuration of elastic skin material and reinforcing material. For example, FIG. 6 illustrates another embodiment, including an article of footwear 310 including a sole structure 312 fixedly attached to an upper 314. Upper 314 may include elastic skin material 329, which is visible in a plurality of sections 360, and an inelastic reinforcing material 334. The features and components of the embodiment shown in FIG. 6 may have substantially similar characteristics as their counterpart features discussed above with respect to FIGS. 4 and 5.

As shown in the enlarged portion of FIG. 6, elastic skin material 329 may be constricted, wrinkled, and/or concave when no foot is inserted within cavity 328 of footwear 310. For purposes of comparison, a first window dimension 336 and a second window dimension 338 indicate the width of elastic skin material 329 between adjacent skeletal strips of reinforcing material 334.

Figure 7:
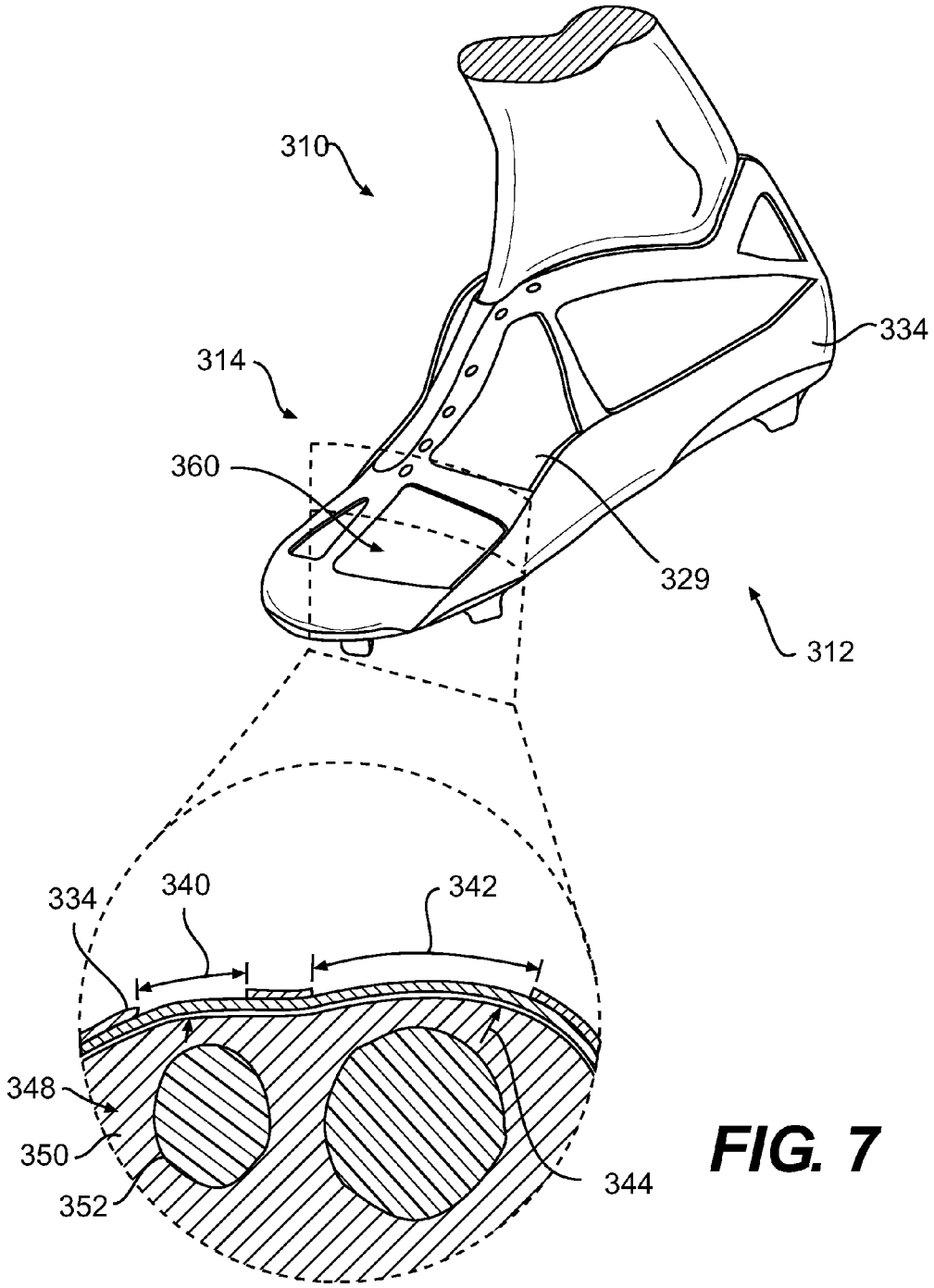
FIG. 7 is a view of the article of footwear of FIG. 6 shown with a foot inserted.

FIG. 7 shows the article of footwear 310 of FIGS. 5 and 6 with a foot 348 inserted. As shown in FIG. 7, foot 348 may include flesh 350 and bones 352. With foot 348 inserted, upper 314 of footwear 310 may expand substantially radially, as indicated by arrows 344. In addition, upper 314 may expand in a circumferential direction, by virtue of the expansion of elastic skin material 329 within plurality of sections 360 in the areas between portions of reinforcing material 334. For example, a third window dimension 340 and a fourth window dimension 342 are shown in FIG. 7. As illustrated, third window dimension 340 may be greater than first window dimension 336. Similarly, fourth window dimension 342 may be greater than second window dimension 338.

Figure 8:
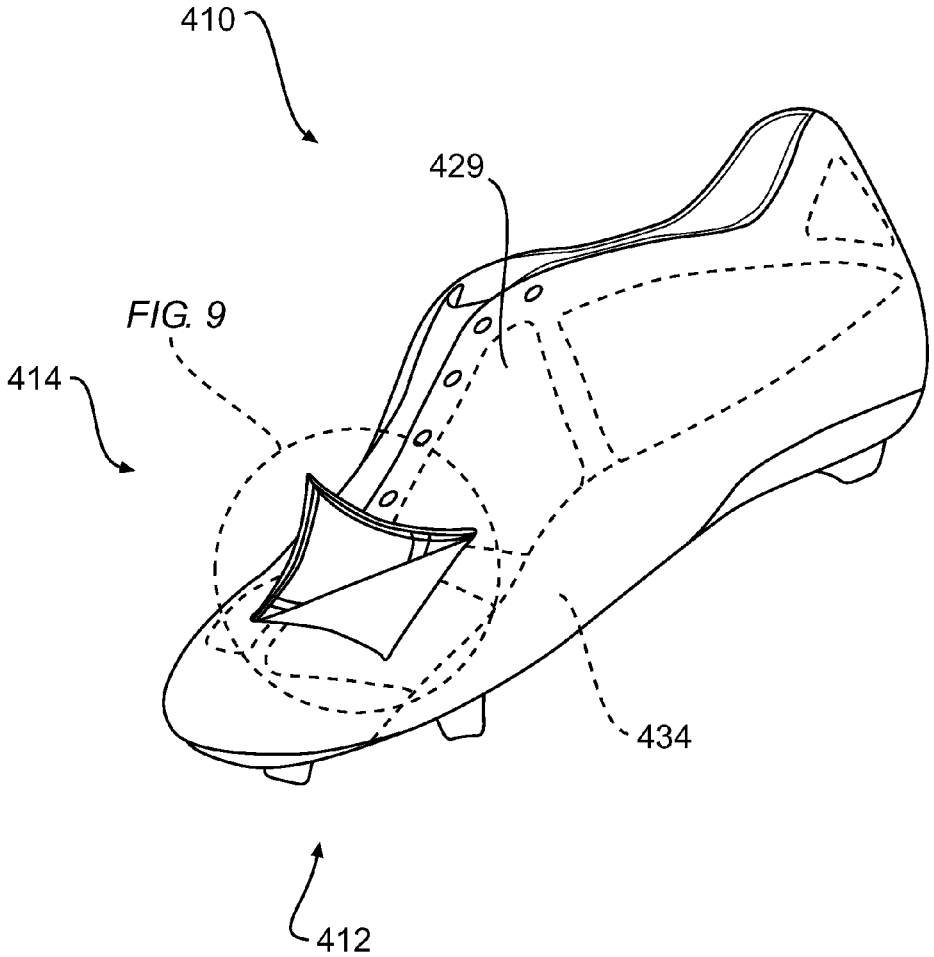
FIG. 8 is a schematic perspective view of an embodiment of an article of footwear having an upper formed of an elastic skin material and a substantially inelastic reinforcing material disposed internally of the skin material.

FIG. 8 illustrates a stretch-to-fit embodiment having substantially the same configuration as FIGS. 6-7. For example, FIG. 8 shows an article of footwear 410 including a sole structure 412 fixedly attached to an upper 414. Upper 414 may include elastic skin material 429 and an inelastic reinforcing material 434. In FIG. 8, however, inelastic reinforcing material 434 is shown with hidden lines to illustrate inelastic reinforcing material 434 on an inner side of elastic skin material 429, thereby forming an internal skeletal structure. It will be noted, however, that any of the disclosed embodiments may incorporate inelastic reinforcing material on the inside of the elastic skin material, on the outside of elastic skin material, or both.

Figure 9:
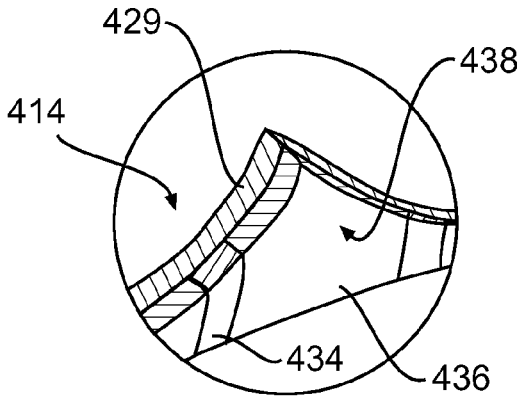
FIG. 9 is an enlarged cutaway view showing layering in the upper of an article of footwear as illustrated in peel-away portion indicated in FIG. 8.

FIG. 8 also includes a peel-away section that illustrates the layers of upper 414. An enlarged view of the peel-away section is shown in FIG. 9. As further shown in FIG. 9, upper 414 may include an additional material 436 selectively placed adjacent to elastic skin material 429 between sections of inelastic reinforcing material 434. FIG. 9 is a schematic illustration of the arrangement of layers of upper 414. In some cases, reinforcing material 434 and additional material 436 may be arranged side-by-side in an abutting relationship, as schematically shown in FIG. 9. In some embodiments, reinforcing material 434 and additional material 436 may overlap slightly in order to permit the materials to be stitched and/or glued to one another, thus creating a seam. Those having ordinary skill in the art will recognize suitable arrangements of adjacent material layers. FIG. 9 is intended to generally encompass all such suitable arrangements.

In some embodiments, additional material 436 may include a compressible foam material. Such a compressible foam material may fill space between reinforcing material 434, as shown in FIG. 9, in order to provide a substantially smooth inner surface 438 of upper 414. Compressible foam material may also provide comfort against the foot, as well as minimal cushioning when impacting a soccer ball, for example.

In other embodiments, additional material 436 may include a wind-stopping material. Such a wind-stopping material may enable a relatively thin elastic material to be used for upper 414 without limiting footwear 410 to warm weather use. That is, wind-stopping material disposed internal to elastic skin material 429 may prevent discomfort due to wind and cold weather. Alternatively, or additionally, additional material 436 may include a water-proof material. In some cases, inelastic reinforcing material 434 may be wind-proof and/or water-proof. Therefore, it may be beneficial to provide a wind-stopping and/or water-proof material in the areas between inelastic reinforcing material 434.

In some embodiments, additional material 436 may be provided solely in areas between reinforcing material, as shown in FIG. 9. In other embodiments, additional material 436 may extend underneath both reinforcing material and elastic skin material. In the case of a compressible foam material, it may be beneficial to provide a foam layer that extends across seams between various layers of other material in order to provide comfort. In the case of wind-stopping and/or water-proof material, it may be advantageous to incorporate such material underneath both elastic and inelastic material sections.

Figure 10:
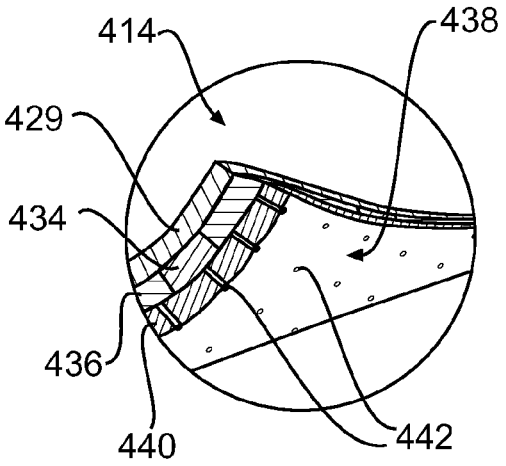
FIGS. 10-14 are enlarged cutaway views showing alternative layering embodiments for an upper of an article of footwear.

In addition to the materials discussed above, additional layers may be provided in a stretch-to-fit upper. FIGS. 10-14 illustrate further exemplary layering configurations. FIG. 10 illustrates an embodiment that further includes a liner 440 located internally of elastic skin material 429. Liner 440 may be the inner-most layer of upper 414, thus forming inner surface 438. As shown in FIG. 10, in some embodiments, liner 440 may include perforations 442. Liner 440 may be a partial or full-length liner. Liner 440 may provide comfort, by providing cushioning and by providing a smooth inner surface 438 for the foot of a wearer to contact. In addition, a perforated liner may provide ventilation/breathability. In some embodiments, liner 440 may be perforated only in areas adjacent to unreinforced sections of elastic skin material 429. In addition, in some embodiments, liner 440 may include a moisture absorbing properties. For example, liner 440 may be configured to wick sweat away from a wearer's foot. In other embodiments, liner 440 may be water repellant, so as to prevent liner 440 from becoming water-logged.

Figure 11:
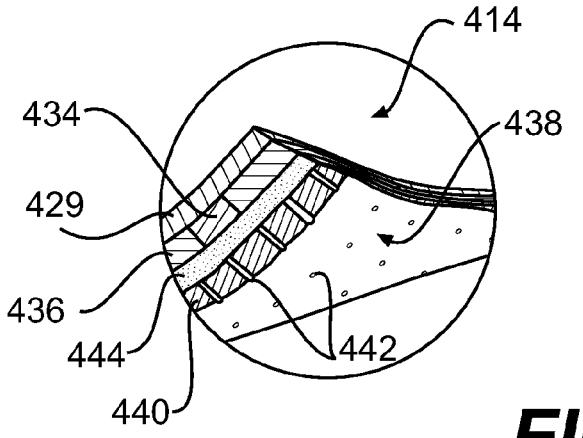

FIG. 11 illustrates an upper embodiment wherein additional material 436 is a wind-stopping or water-proof material. As shown in FIG. 11, upper 414 may also include a compressible foam material layer 444 disposed internally of elastic skin material 429 and additional material 436. As further shown in FIG. 11, such an embodiment may further include liner 440. As shown in FIG. 11, foam material layer 444 and liner 440 may extend underneath both reinforcing material 434 and additional material 436. In some embodiments, foam material layer 444 and liner 440 may be full-length layers, that is, lining substantially all of the inner cavity defined by upper 414.

Figure 12:
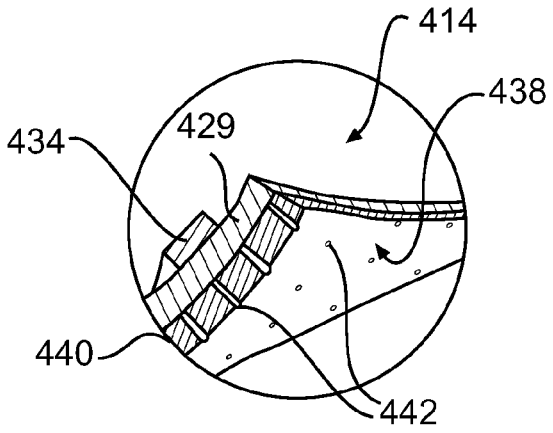
Figure 13:
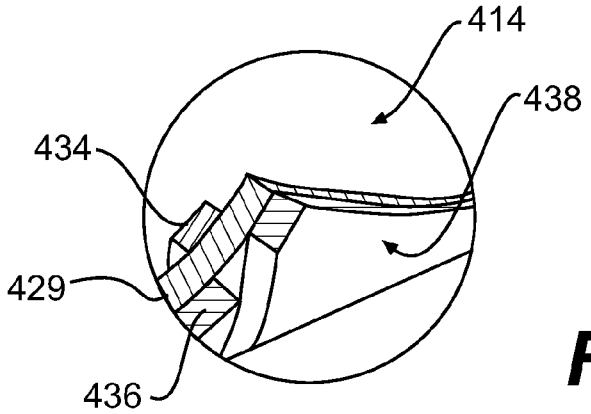
Figure 14:
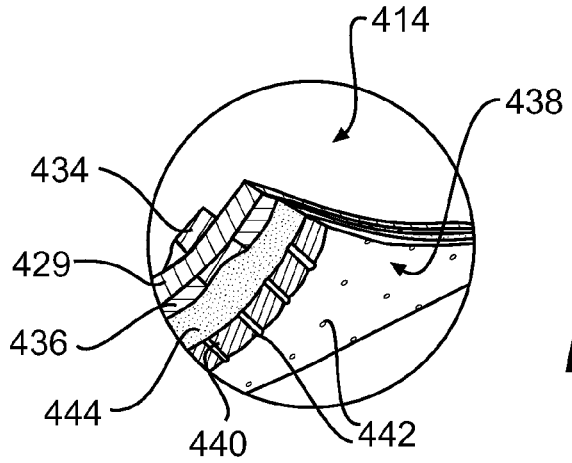

FIGS. 12-14 show embodiments wherein inelastic reinforcing material 434 is disposed external to elastic skin material 429. FIG. 12 shows an upper 414 with an externally disposed skeletal structure formed by reinforcing material 434 and a full-length, perforated liner 440. FIG. 13 illustrates an embodiment, wherein additional material 436 is disposed internal to elastic skin material 429 only in unreinforced areas of elastic skin material 429. It will be noted that the thicknesses of the material layers in each of FIGS. 9-14 are exaggerated for purposes of illustration. Therefore, the unevenness of inner surface 438 shown in FIG. 13 that is caused by the transition between areas including additional material 436 and areas wherein additional material 436 is omitted is also exaggerated. FIG. 14 shows a similar embodiment to that shown in FIG. 13, and further includes a compressible foam layer 444, and a perforated liner 440. The features and components of the embodiments shown in FIGS. 12-14 may be substantially the same as discussed above with respect to FIGS. 9-11.

It will be noted that layering materials disposed internal to elastic skin material 429 (for example, compressible foam material, wind-stopping material, water-proof material, and/or liners) may also be elastic. This may preserve the elastic qualities of upper 414 in unreinforced areas. Such materials may have the same or different amounts of elasticity as elastic skin material 429.

Figure 15:
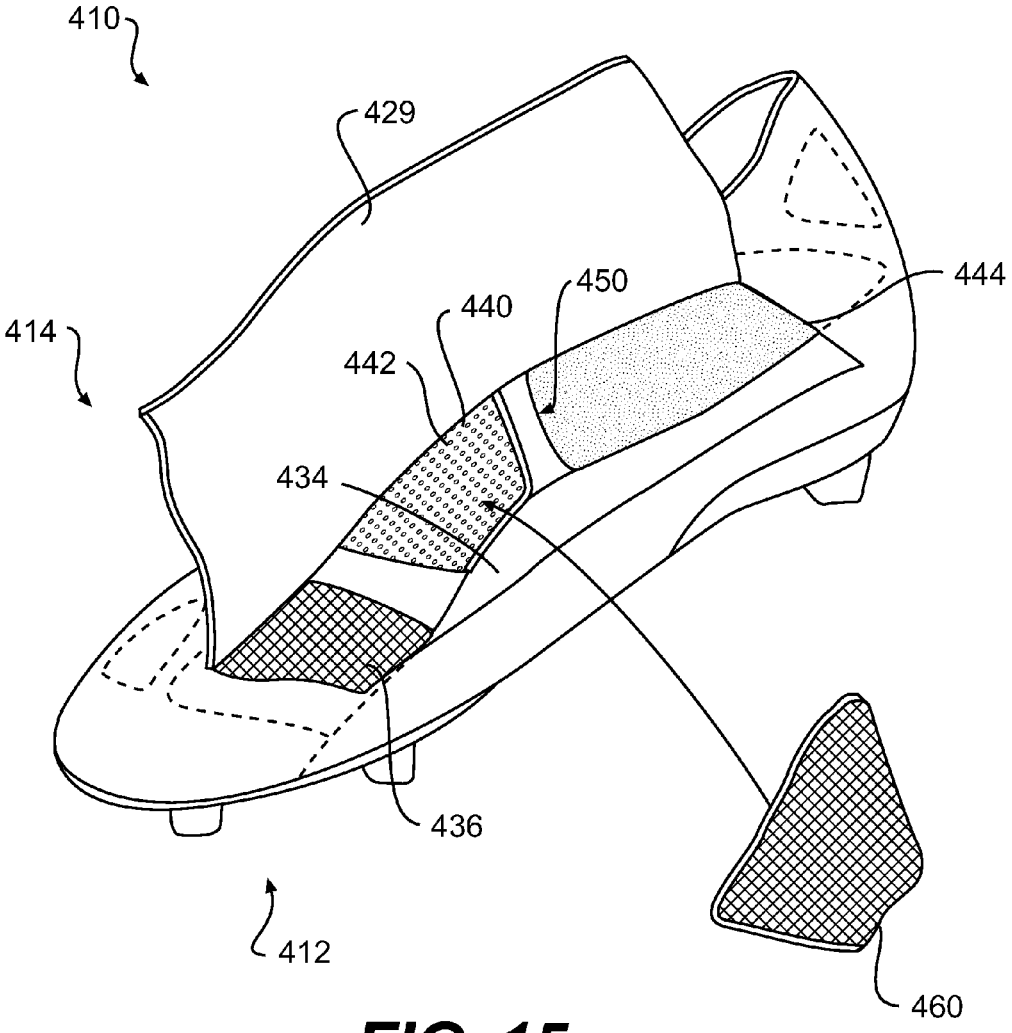
FIG. 15 is a schematic perspective view of the article of footwear of FIG. 8 shown with a peel-away section showing internal structures.

FIG. 15 illustrates article of footwear 410 of FIG. 8 with a peel-away section showing internal structures. For example, beneath elastic skin material 429, may lie plurality of skeletal portions 450 that comprise inelastic reinforcing material 434. In addition, FIG. 15 shows, beneath elastic skin material 429, additional material 436, which can be a wind stopping material and/or a water proof material. Also beneath elastic skin material 429 may be foam material 444.

The locations of additional material 436 and foam material 444 may vary and may be located in any suitable position. For example, in some embodiments, as shown in FIG. 15, additional material 436 may be provided in a toe region of footwear 410 where wind and water are likely to enter footwear during running, and foam material 444 on a medial and/or lateral portion of upper 414, where wind and water are less likely to enter footwear 410 while running. In this medial/lateral location, foam material 444 may provide ventilation without permitting excessive wind from entering footwear 410. As also shown in FIG. 15, panels of additional material 436 and foam material 444 may be located between skeletal portions 450 of reinforcing material 434. As discussed above, in some embodiments, such materials may be provided as full-length (or substantially full-length) layers.

FIG. 15 shows a panel 460 of additional material 436 removed from footwear 410 in order to illustrate liner 440 with perforations 442. As shown in FIG. 15, liner 440 may be located beneath reinforcing material 434, additional material 436, and foam material 444.

Figure 16:
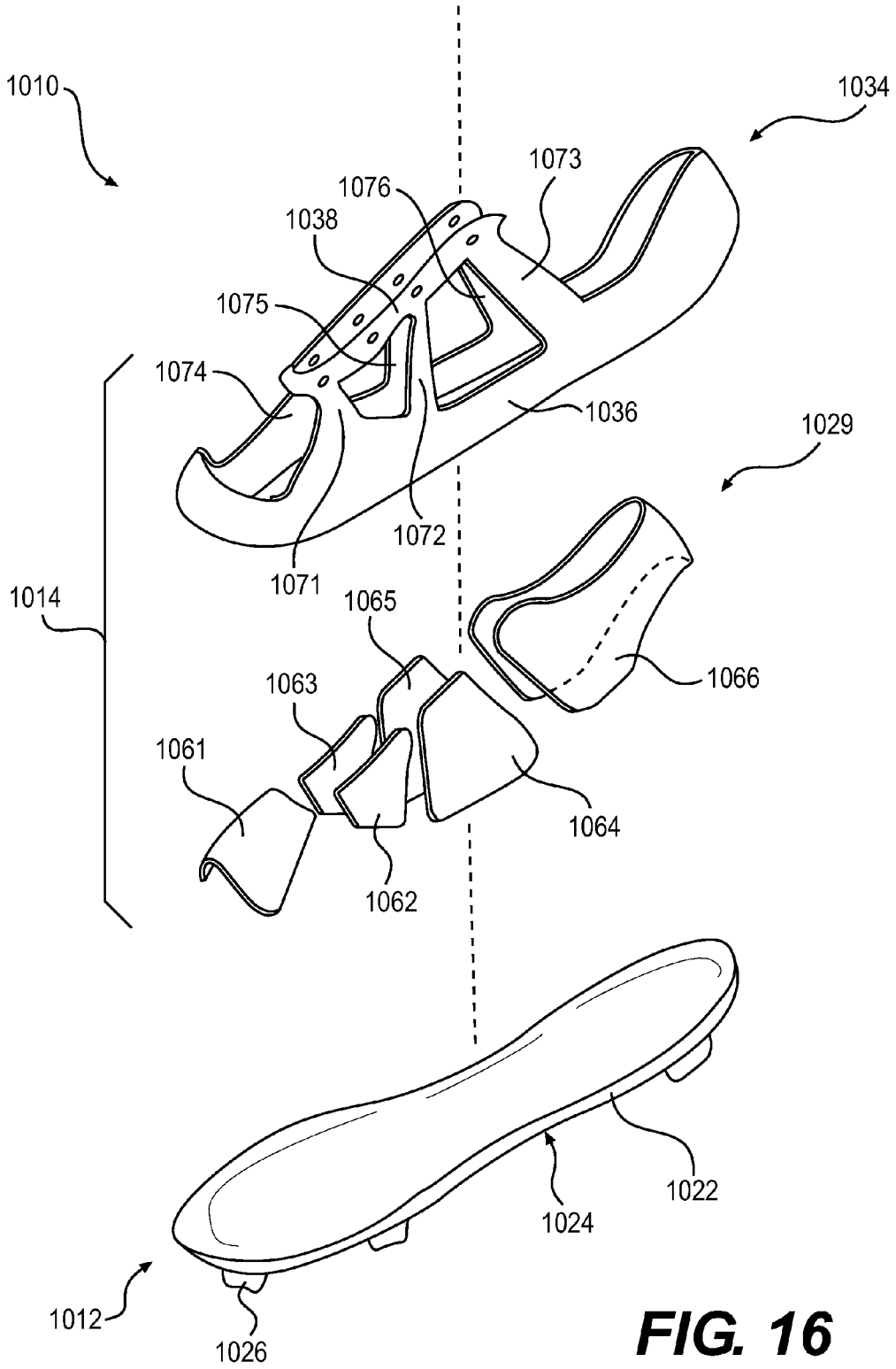
FIG. 16 illustrates an exploded view of a footwear embodiment having elastic panels.

FIG. 16 illustrates an exploded view of a footwear embodiment in which the elastic upper material is provided only in panels between reinforcing structure. As show in FIG. 16, an article of footwear 1010 may include a sole structure 1012 including a ground engaging sole component 1022 having a lower surface 1024 and ground engaging members 1026 extending from lower surface 1024. In addition, footwear 1010 may include an upper 1014. Upper 1014 may also include an elastic skin material 1029 forming at least a portion of an external surface of upper 1014. These features and components may have substantially similar characteristics as their counterpart features in embodiments discussed above.

As shown in FIG. 16, inelastic reinforcing material 1034 may form a skeletal structure. In some embodiments, such a skeletal structure may be provided internal to elastic skin material 1029, forming an endoskeleton, as will be discussed in great detail below. In some embodiments, however, such a skeletal structure may be provided external to elastic skin material 1029, forming an exoskeleton, as shown in FIG. 16.

In some embodiments, inelastic reinforcing material 1034 may be configured to surround one or more unreinforced sections of elastic skin material 1029 of upper 1014. For example, as shown in FIG. 16, unreinforced sections of upper 1014 may include a first elastic panel 1061, a second elastic panel 1062, a third elastic panel 1063, a fourth elastic panel 1064, and a fifth elastic panel 1065. These elastic panels may be secured between reinforcing material sections, such as may be surrounded by a lower peripheral strip 1036, an instep region strip 1038, and a plurality of skeletal strips, including a first skeletal strip 1071, a second skeletal strip 1072, and a third skeletal strip 1073 extending between lower peripheral strip 1036 and instep region strip 1038. Reinforcing material 1034 may further include additional skeletal strips on an opposite side of footwear 1010, including a fourth skeletal strip 1074, a fifth skeletal strip 1075, and a sixth skeletal strip 1076.

Figure 17:
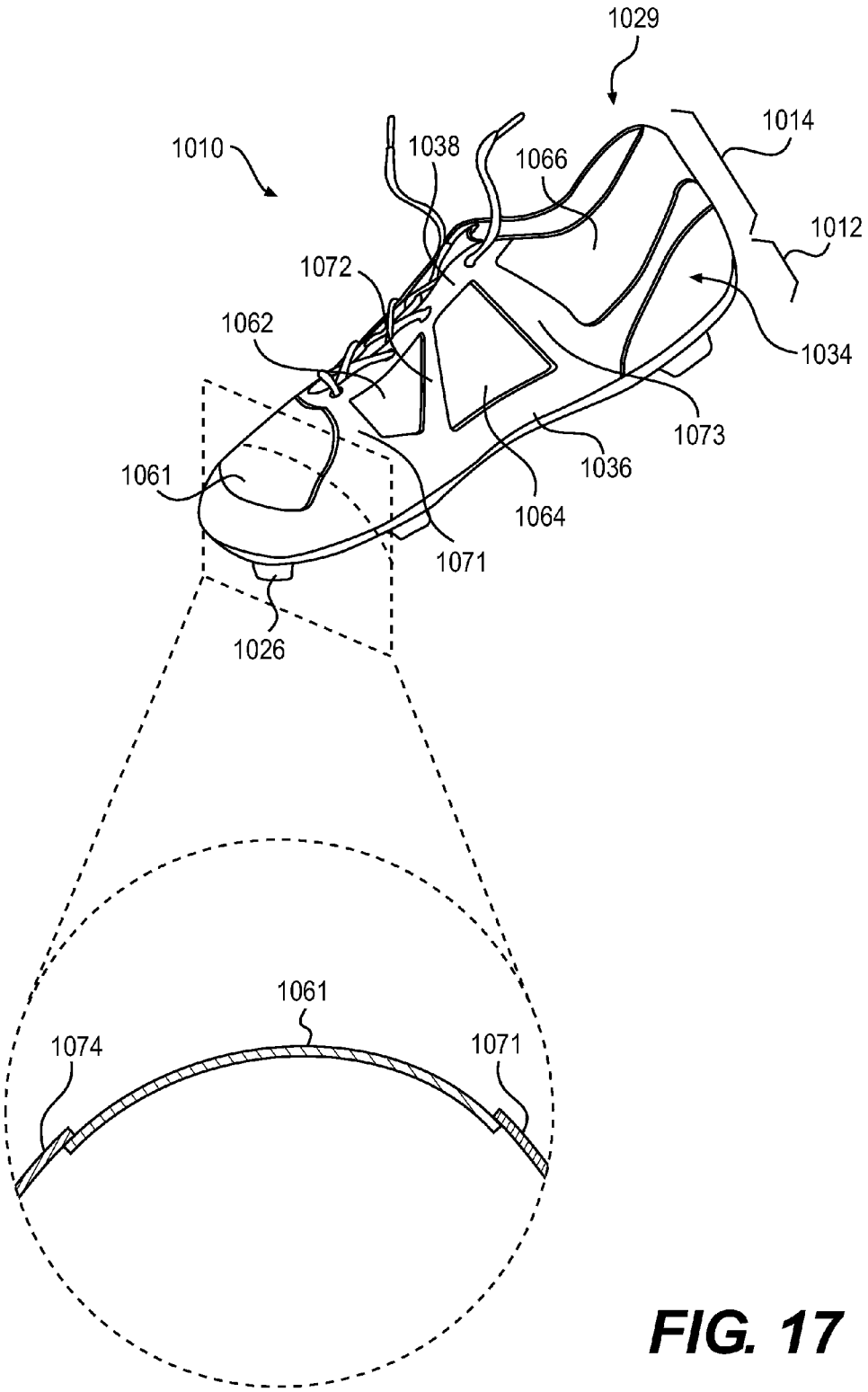
FIG. 17 is an assembled view of the article of footwear of FIG. 16, and also shows an enlarged partial cross-sectional view of a toe region of the article of footwear.

FIG. 17 is an assembled view of footwear 1010, and further shows an enlarged cross-sectional view of a toe region of footwear 1010. As shown in FIG. 17, first elastic panel 1061, second elastic panel 1062, third elastic panel 1063, fourth elastic panel 1064, and fifth elastic panel 1065 may be secured between reinforcing material structures, such as first skeletal strip 1071, second skeletal strip 1072, third skeletal strip 1073, fourth skeletal strip 1074, fifth skeletal strip 1075, sixth skeletal strip 1076, lower peripheral strip 1036, and instep region strip 1038.

As discussed above, the elastic panels may be secured to the inelastic reinforcing material in any suitable configuration. In an exemplary configuration shown in FIG. 17, the elastic panels may be secured to an inside surface of the reinforcing structure. For example, as shown in the cross-sectional view in FIG. 17, first elastic panel 1061 may be secured to the inside surfaces of first skeletal strip 1071 and fourth skeletal strip 1074.

Any suitable method may be used to secure these components together. For example, stitching, adhesive, welding, or any other suitable method. As shown in FIG. 17, a minimal overlap may be used to secure these components together. This may provide a reduced weight of footwear 1010. In addition, minimal overlap may be utilized for comfort.

It will also be noted that additional layers may be included in footwear 1010, although none are shown. For example, waterproof or windproof layers, foam layers, and/or a liner material may be included. Such layers may be full length or partial length. Further, such layers may be provided, in some cases, only between the reinforcing structure. Options for placement of additional layers are discussed above regarding other embodiments, particularly the embodiments shown in FIGS. 8-15.

Figure 18:
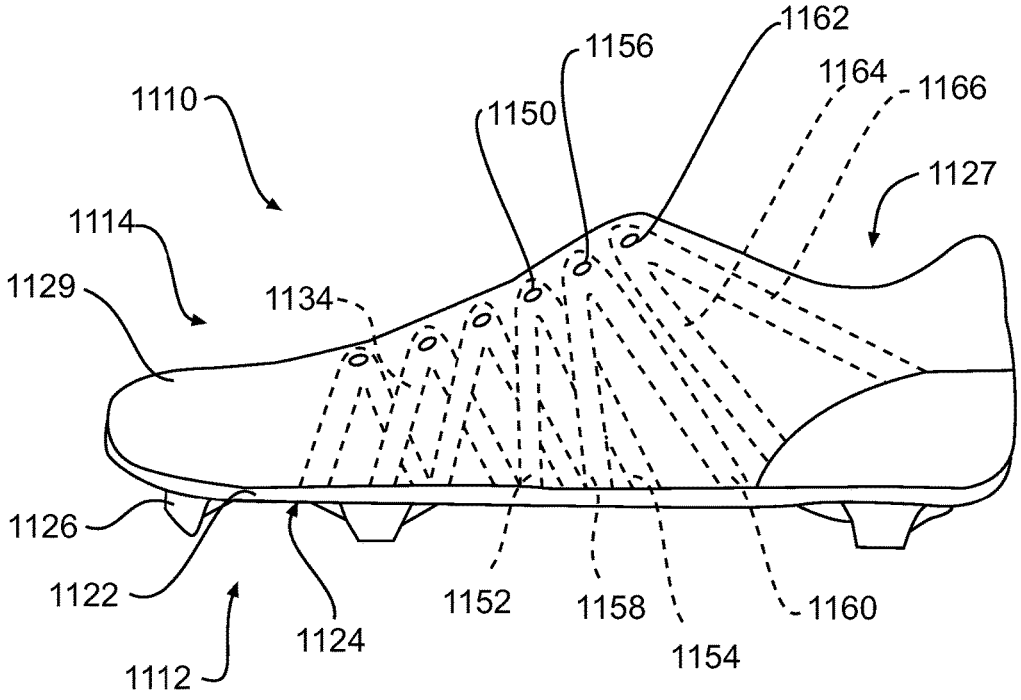
FIG. 18 is a side view of another embodiment of an article of footwear having an upper formed of an elastic skin material and a substantially inelastic reinforcing material forming a skeletal structure.

FIG. 18 illustrates another reinforced, stretch-to-fit upper embodiment. As shown in FIG. 18, an article of footwear 1110 may include a sole structure 1112 fixedly attached to an upper 1114. Sole structure 1112 may include a ground engaging sole component 1122 having a lower surface 1124 and ground engaging members 1126 extending from lower surface 1124. Upper 1114 may define an opening 1127 to receive a foot of a wearer. In addition, upper 1114 may include an elastic skin material 1129 and an inelastic reinforcing material 1134. The features and components of FIG. 18 may have substantially the same characteristics as their counterparts in other embodiments discussed above. Notably, reinforcing material 1134 and its features may be located internally of elastic skin material 1129, as shown in FIG. 18. In some embodiments, however, reinforcing material 1134 may be located externally of elastic skin material 1129.

As shown in FIG. 18, upper 1114 may include reinforcing strips associated with eyelets configured to receive a lace. For example, upper 1114 may include a first eyelet 1150 configured to receive a lace. Reinforcing material 1134 may include a first reinforcing strip 1152 and a second reinforcing strip 1154 associated with first eyelet 1150 and extending away from the first eyelet 1150. As shown in FIG. 18, first reinforcing strip 1152 and second reinforcing strip 1154 may extend divergently from one another (for example in an inverted "V" configuration). In addition, upper 1114 may include a second eyelet 1156. Reinforcing material 1134 may include a third reinforcing strip 1158 and a fourth reinforcing strip 1160 associated with second eyelet 1156 and extending away from second eyelet 1156. Third reinforcing strip 1158 and fourth reinforcing strip 1160 may extend divergently from one another, as shown in FIG. 18. In some embodiments, second reinforcing strip 1154 and third reinforcing strip 1158 may extend in a criss-cross manner with respect to one another, as shown in FIG. 18.

In some embodiments, upper 1114 may include adjacent reinforcing strips that do not overlap/criss-cross. For example, as shown in FIG. 18, upper 1114 may include a third eyelet 1162. Reinforcing material 1134 may include a fifth reinforcing strip 1164 and a sixth reinforcing strip 1166 associated with third eyelet 1162 and extending away from the third eyelet 1162. Fifth reinforcing strip 1164 and sixth reinforcing strip 1166 may extend divergently from one another. As shown in FIG. 18, fourth reinforcing strip 1160 and adjacent reinforcing strip 1164 may be arranged in a non-overlapping fashion. For example, fourth reinforcing strip 1160 and adjacent reinforcing strip 1164 may be arranged in a parallel fashion. Thus, upper 1114 may include adjacent reinforcing strips that overlap and/or adjacent reinforcing strips that are non-overlapping.

The footwear embodiments discussed above may be manufactured using any suitable methods. Such methods may include forming an externally exposed portion of an upper from an elastic skin material and fixedly attaching a sole structure to the upper. In addition, such methods may include assembling, as part of the upper, a substantially inelastic reinforcing material, by selectively locating the reinforcing material adjacent portions of the elastic skin material.

In some embodiments, assembling the article of footwear may include attaching the substantially inelastic reinforcing material to the elastic skin material in at least one location. Also, the method may include assembling, as part of the upper, an additional material selectively located adjacent the elastic skin material and between sections of the reinforcing material. Such additional material may include a compressible foam material, a wind-stopping material, and/or a water-proof material. Further, the method may also include assembling, as a part of the upper, an inner liner formed of a perforated material.

Assembly of the various footwear components discussed above may include any suitable fixation methods. For example, attachment of components of the upper may include stitching, gluing, welding, or other suitable fixation methods.

While various embodiments have been described, the description is intended to be exemplary, rather than limiting and it will be apparent to those in the art that many more embodiments and implementations are possible that are within the scope of the current embodiments. Accordingly, the current embodiments are not to be restricted except in light of the attached claims and their equivalents. Features described in one embodiment may or may not be included in other embodiments described herein. Also, various modifications and changes may be made within the scope of the attached claims.

What is claimed is:

1. An article of footwear including an upper, the article of footwear comprising:

a sole component having a ground-engaging surface;

an elastic skin material forming at least a portion of an external surface of the upper and attached to the sole component;

a substantially inelastic reinforcing material selectively located adjacent portions of the elastic skin material to form reinforced portions of the elastic skin material and unreinforced portions of the elastic skin material, the unreinforced portions of the elastic skin material forming a substantial majority of the external surface of the upper; and an additional material selectively placed adjacent to the elastic skin material;

wherein the elastic skin material is more elastic than the substantially inelastic reinforcing material;

wherein the substantially inelastic reinforcing material includes a peripheral strip that is disposed proximate to a junction of the sole component and the elastic skin material;

wherein the substantially inelastic reinforcing material includes a plurality of strips extending from the peripheral strip; and wherein the additional material and the plurality of strips of reinforcing material are arranged side-by-side such that the additional material extends from one of the plurality of strips of reinforcing material to another of the plurality of strips of reinforcing material.

2. The article of footwear according to claim 1, wherein the substantially inelastic reinforcing material is located on an inner side of the elastic skin material, thereby forming an internal skeletal structure.

3. The article of footwear according to claim 1, wherein the substantially inelastic reinforcing material is located on at least a portion of an outer side of the elastic skin material, thereby forming an external skeletal structure.

4. The article of footwear according to claim 1, wherein the additional material is selectively placed between sections of the reinforcing material.

5. The article of footwear according to claim 4, wherein the additional material is a compressible foam material.

6. The article of footwear according to claim 4, wherein the additional material is a wind-stopping material.

7. The article of footwear according to claim 4, wherein the additional material is a water-proof material.

8. The article of footwear according to claim 1, wherein the upper further includes a perforated liner material located internally of the elastic skin material.

9. The article of footwear according to claim 1, wherein the ground-engaging surface includes a plurality of ground engaging members extending from the sole component and configured to provide traction.

10. The article of footwear according to claim 8, wherein the perforated liner material is a full-length liner, lining substantially all of an inner cavity defined by the upper.

11. The article of footwear according to claim 1, wherein the upper includes at least a first eyelet configured to receive a lace.

12. The article of footwear according to claim 11, wherein the upper includes a lace configured to secure the article of footwear on the foot of a wearer.

13. The article of footwear according to claim 11, wherein the plurality of strips extend from the peripheral strip toward the first eyelet.

14. The article of footwear according to claim 1, wherein the inelastic reinforcing material is configured to surround an unreinforced section of the elastic skin material of the upper.

15. The article of footwear according to claim 1, wherein the additional material, the one of the plurality of strips of reinforcing material, and the other of the plurality of strips of reinforcing material are located on an inner side of the elastic skin material.

16. The article of footwear according to claim 1, wherein the additional material abuts the one of the plurality of strips of reinforcing material or the other of the plurality of strips of reinforcing material.

17. A method of making an article of footwear, forming, from an elastic skin material, an externally exposed portion of an upper configured to receive a foot of a wearer;

fixedly attaching a sole structure having a ground-engaging surface to the upper;

assembling, as part of the upper, a substantially inelastic reinforcing material that is less elastic than the elastic skin material, by selectively locating the reinforcing material adjacent portions of the elastic skin material to form reinforced portions of the elastic skin material and unreinforced portions of the elastic skin material, the unreinforced portions of the elastic skin material forming a substantial majority of an external surface of the upper; and assembling, as part of the upper, an additional material adjacent the elastic skin material;

wherein assembling the substantially inelastic reinforcing material includes positioning a peripheral strip of the inelastic reinforcing material proximate to a junction of the elastic skin material and the sole structure; and wherein positioning the peripheral strip of inelastic reinforcing material includes extending a plurality of strips of the inelastic reinforcing material from the peripheral strip in a direction away from the ground-engaging surface; and wherein assembling the additional material includes arranging the additional material and the plurality of strips of the inelastic reinforcing material side-by-side such that the additional material extends from one of the plurality of strips of reinforcing material to another of the plurality of strips of reinforcing material.

18. The method of claim 17, further including attaching the substantially inelastic reinforcing material to the elastic skin material in at least one location.

19. The method of claim 18, wherein the additional material is located between sections of the reinforcing material.

20. The method of claim 19, wherein the additional material includes at least one of a compressible foam material, a wind-stopping material, and a water-proof material.

21. The method of claim 17, further including assembling, as a part of the upper, an inner liner formed of a perforated material.

22. The article of footwear according to claim 1, wherein the upper includes at least a first eyelet formed in an instep region strip and configured to receive a lace.

23. The method of claim 17, further including forming at least a first eyelet formed in an instep region strip, the first eyelet configured to receive a lace.

24. The method of claim 17, wherein the additional material, the one of the plurality of strips of reinforcing material, and the other of the plurality of strips of reinforcing material are located on an inner side of the elastic skin material.

25. The method of claim 17, wherein the additional material abuts the one of the plurality of strips of reinforcing material or the other of the plurality of strips of reinforcing material.

* * * * *